US008192218B2

(12) United States Patent
Sasaki

(10) Patent No.: US 8,192,218 B2
(45) Date of Patent: Jun. 5, 2012

(54) SPRINGLESS SCREW TYPE AND BAYONET TYPE CONNECTOR

(75) Inventor: Tomokazu Sasaki, Tokyo (JP)

(73) Assignee: Yamatake Corporation, Tokyo (JP)

( * ) Notice: Subject to any disclaimer, the term of this patent is extended or adjusted under 35 U.S.C. 154(b) by 0 days.

(21) Appl. No.: 13/115,285

(22) Filed: May 25, 2011

(65) Prior Publication Data

US 2011/0294329 A1 Dec. 1, 2011

(30) Foreign Application Priority Data

May 28, 2010 (JP) ..... 2010-122927

(51) Int. Cl.
*H01R 4/38* (2006.01)

(52) U.S. Cl. ..... 439/320

(58) Field of Classification Search ..... 439/320, 439/322

See application file for complete search history.

(56) References Cited

U.S. PATENT DOCUMENTS

| | | | | |
|---|---|---|---|---|
| 2,962,688 | A * | 11/1960 | Werner | 439/320 |
| 3,039,072 | A * | 6/1962 | Robinson et al. | 439/320 |
| 4,440,464 | A * | 4/1984 | Spinner | 439/218 |
| 4,521,066 | A * | 6/1985 | Kempe | 439/320 |
| 6,280,229 | B1 * | 8/2001 | Harting et al. | 439/393 |
| 6,957,972 | B2 * | 10/2005 | Starke et al. | 439/320 |
| 6,986,680 | B2 * | 1/2006 | Wu | 439/551 |
| 6,994,579 | B2 * | 2/2006 | Yokoigawa et al. | 439/320 |
| 7,151,223 | B2 * | 12/2006 | Auray et al. | 174/70 R |
| 7,154,042 | B2 * | 12/2006 | Auray et al. | 174/70 R |
| 7,331,807 | B2 * | 2/2008 | Scholler et al. | 439/320 |
| 7,338,306 | B1 * | 3/2008 | Chen et al. | 439/320 |
| 7,824,204 | B2 * | 11/2010 | Fujiwara et al. | 439/320 |
| 2005/0118853 | A1 * | 6/2005 | Starke et al. | 439/320 |
| 2006/0051999 | A1 * | 3/2006 | Allemann et al. | 439/320 |

FOREIGN PATENT DOCUMENTS

JP 2007-103046 A 4/2007

* cited by examiner

*Primary Examiner* — Tulsidas C Patel
*Assistant Examiner* — Vladimir Imas
(74) *Attorney, Agent, or Firm* — McDermott Emery & Will LLP

(57) ABSTRACT

A male connector comprises: a holder, attached rotatably to the outer peripheral surface of a plug main unit portion, having male threads formed on the outer peripheral surface thereof and having sliding grooves formed at specific intervals at the rearward side on the outer peripheral surface; and a knob portion, formed integrally with engaging protruding portions that have engaging hooks on the tip end sides thereof and that sliding in the sliding grooves, where the knob portion is attached so as to be able to rotate together with the holder.

7 Claims, 5 Drawing Sheets

(a)

(b)

Prior Art

SPRINGLESS SCREW TYPE AND BAYONET TYPE CONNECTOR

CROSS REFERENCE TO RELATED APPLICATIONS

The present application claims priority under 35 U.S.C, §119 to Japanese Patent Application No. 2010-122927, filed May 28, 2010, which is incorporated herein by reference.

FIELD OF TECHNOLOGY

The present invention relates to a connector that can be connected in, for example, both the bayonet-type and the screw-type method.

BACKGROUND OF THE INVENTION

In conventional connectors, a male connector 100 with an electric cable on one end, as illustrated in FIGS. 6 (*a*) and 6 (*b*), includes a knob portion 101 with male threads 101*a* and sliding grooves 101*b* formed on the outer peripheral surface thereof; and a retaining hardware 102, with engaging protruding portions 102*b*, having engaging hooks 102*a* at the tip end side thereof, that slide forward and backward in the sliding grooves 101*b* formed therein. Additionally, the retaining hardware 102 is biased towards the knob portion 101 by a coil spring that is attached there behind (See, for example, Japanese Unexamined Patent Application Publication 2007-103046 ("JP '046")).

Additionally, in a bayonet-type female connector with an electric cable on one end thereof, comprises: a knob portion, wherein engaging grooves are formed on the inner peripheral surface thereof is provided with guiding portions, for guiding engaging hooks 102*a*, and stopper portions for engaging the engaging hook 102*a* when attaching the male connector 100. When the male connector 100 is attached to this bayonet-type female connector, the operator holds the knob portion 101 of the male connector 100 and the knob portion of the female connector, and inserts the male connector 100 into the female connector to insert the engaging hooks 102*a* along the guide portions of the engaging grooves. Following this, the male connector 100 or the female connector is rotated in a specific direction to cause the engaging hooks 102*a* to engage with the stopper portions of the engaging grooves. Doing so makes it possible to electrically connect electric cables coaxially.

On the other hand, in the screw-type female connector with an electric cable on one end thereof, a knob portion is provided wherein female threads for screwing onto the male threads 101*a* are formed on the inner peripheral surface. When connecting the male connector 100 to this screw-type female connector, the operator holds the knob portion 101 of the male connector 100 and the knob portion of the female connector, and screws the male threads 101*a* together with the female threads. At this time, the engaging hooks 102*a* are moved towards the rear, while being biased by the coil spring 103, through the contact with the female threads. Doing so makes it possible to electrically connect electric cables coaxiaily.

In the conventional male connector as disclosed in JP '046, a coil spring 103 is necessary in order to bias the retaining hardware 102 towards the knob portion 101 side in order to connect to both the female connector of the screw-type and the bayonet-type. However, when the coil spring 103 is broken, problems may be caused by the inoperability of the coil spring due to the break, and thus there is a problem in that there are concerns that the connection with the connector might become impossible. Moreover, even if there is just corrosion that is not to the extent that the coil spring 103 breaks, still there are problems that may be caused due to the inoperable state of the coil spring 103 caused by the corrosion, and thus there are problems in that there are concerns that it may become impossible to connect the connector.

The present invention was created in order to solve the problem areas set forth above, and the object thereof is to provide a connector that can connect to both the bayonet type and the screw type, without the use of a coil spring.

SUMMARY OF THE INVENTION

The connector as set forth in the present invention is a connector for connecting electrically between lines by connecting a male connector having a plug main unit portion having a line to a female connector having a socket main unit portion having a line; wherein: the male connector includes a holder that is attached rotatably to the outer peripheral surface of the plug main unit portion, with male threads formed on the outer peripheral surface thereof, with sliding grooves formed with specific spacing on the rearward side of the outer peripheral surface; and a knob portion, formed integrally with engaging protruding portions that have engaging hooks on the tip end sides thereof, and that slide in the sliding grooves, attached so as to be able to rotate together with the holder.

The present invention, structured as set forth above, enables the attachment to female connectors of both the bayonet-type and the screw-type without the use of a coil spring, through the provision of a holder wherein the female threads and sliding grooves are formed on the outer peripheral surface thereof, and a knob portion that is formed integrally with engaging protruding portions that have engaging hooks on the tip end sides thereof and that slide in the sliding grooves.

DETAILED DESCRIPTION OF THE INVENTION

Examples according to the present invention are explained in detail below, referencing the drawings.

Figure 1:
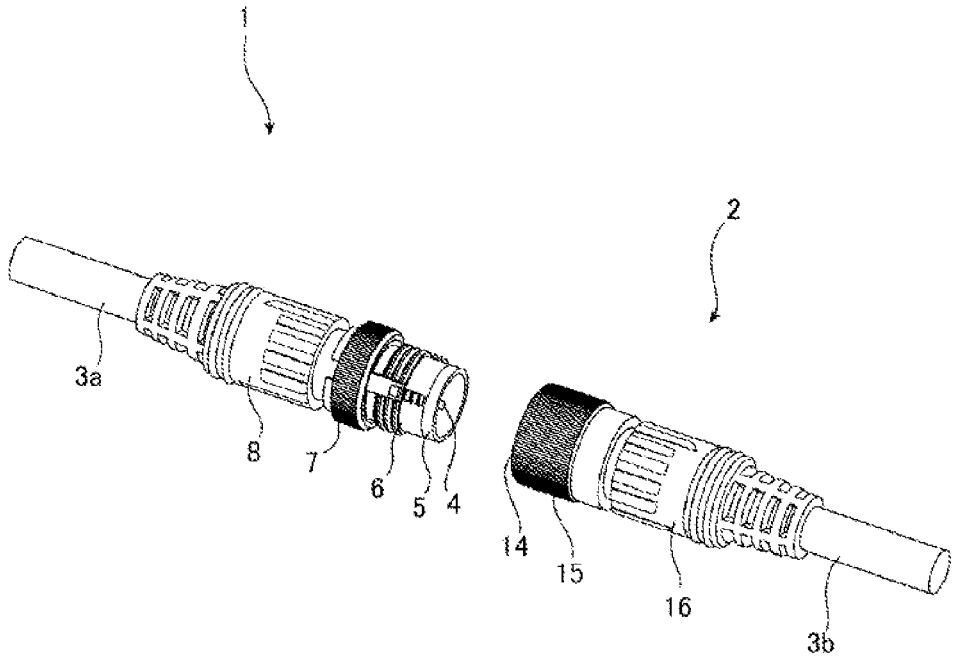
FIG. 1 is a perspective view illustrating the structure of a connector according to an example of the present invention.
Figure 2:
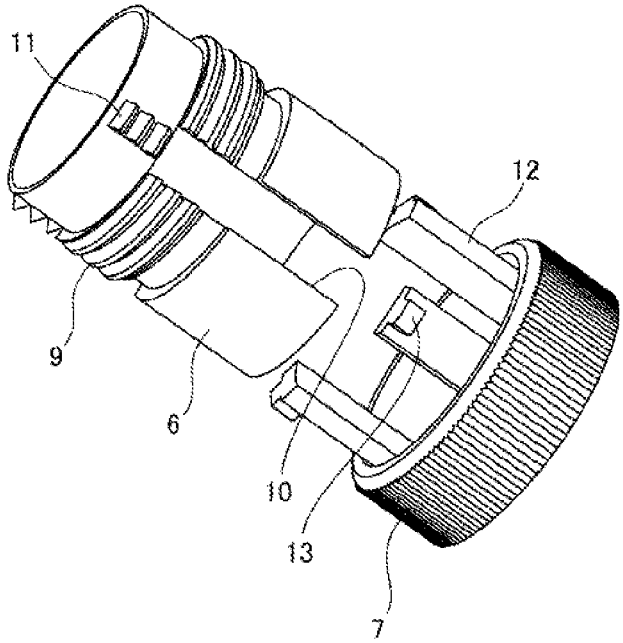
FIG. 2 is a perspective assembly diagram illustrating the structure of the holder and a knob portion according to the example according to the present invention.

FIG. 1 is a perspective view illustrating the structure of a connector according to an example of the present invention. FIG. 2 is a perspective assembly diagram illustrating the structure of a holder 6 and a knob portion 7 according to the present invention. As illustrated in FIG. 1, the connector is structured from a male connector 1, having an electric cable (line) 3*a* on one end side thereof, and a female connector 2, having an electric cable (line) 3*b* on one end side thereof.

The male connector 1, as illustrated in FIG. 1, is structured from a plug main unit portion 5 having a pin terminal 4 that is electrically connected to an end portion of an electric cable 3*a* protruding therefrom, a holder 6 that is attached rotatably to the outer peripheral surface of the plug main unit portion 5, a knob portion 7 that is attached so as to be able to rotate together with the holder 6, and a plug outer covering portion 8.

The holder 6 is an annular member, and, as illustrated in FIG. 2, male threads 9, for securing together with female threads 18 of a screw-type female connector 2*b*, described below, are formed on the outer peripheral surface thereof. Moreover, sliding grooves 10, wherein engaging protruding portions 12, described below, of the knob portion 7 slide, are formed at specific intervals, parallel to the axis. Note that the sliding grooves 10 are formed as cutaway portions so as to pass through to reach the inner peripheral surface side of the holder 6. Moreover, on the forward side of the sliding groove 10 part of the outer peripheral surface of the holder 6, guide thread portions 11 are formed for guiding, to the male thread 9 side, the female threads 18 of the screw-type female connector 2*b*.

The knob portion 7 is the part that is held by the operator when attaching the male connector 1 to the female connector 2, and, as illustrated in FIG. 2, is formed integrally with the engaging protruding portions 12. The engaging protruding portions 12 are formed in parallel with the axis at identical intervals as the sliding grooves 110, and engaging hooks 13, for engaging the engaging grooves 17 of the bayonet-type female connector 2*a* are formed on the tip end sides thereof. Note that the inner diameter of the knob portion 7 is formed to be essentially the same dimension as the outer diameter of the holder 6.

Figure 3:
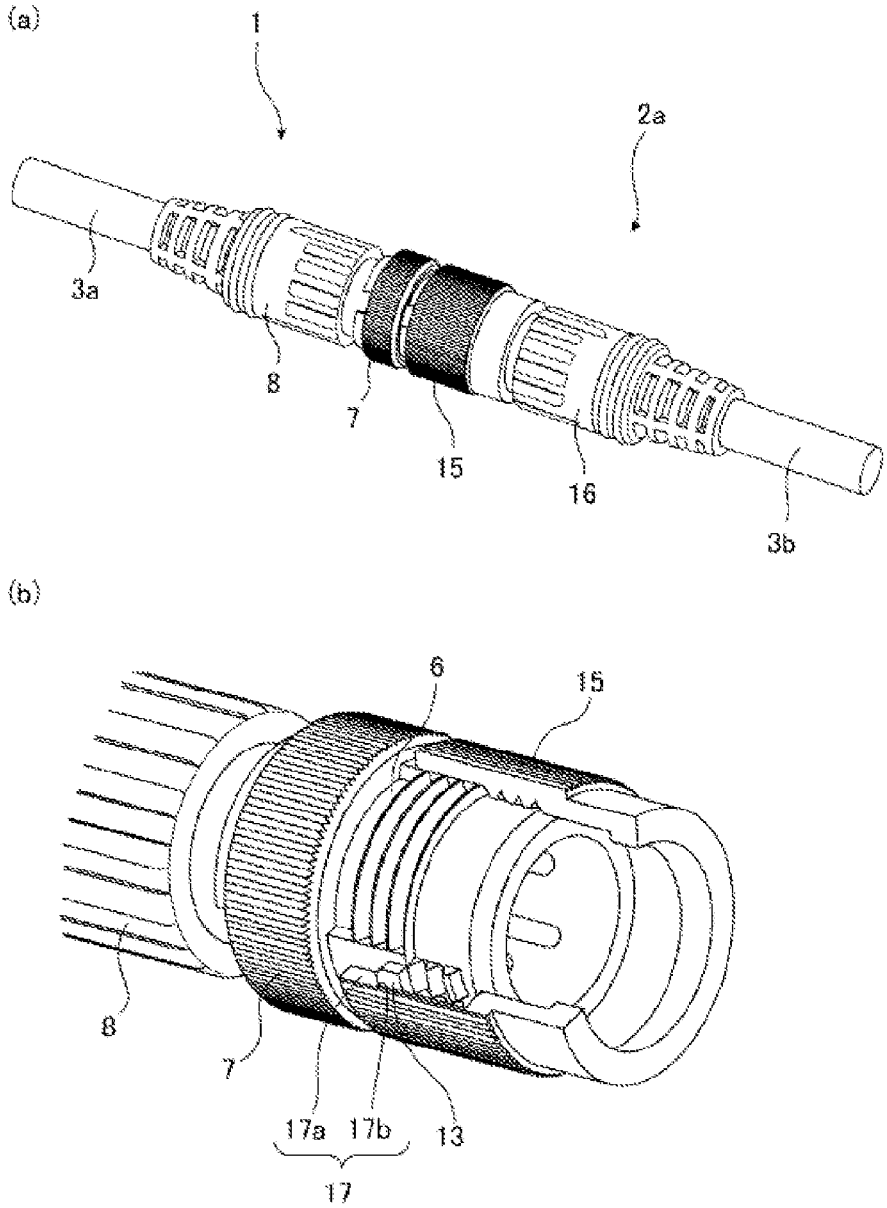
FIG. 3 (*a*) is a perspective diagram and FIG. 3 (*b*) is a partial cutaway perspective diagram, of the case wherein the male connector according to the present invention is connected to a bayonet-type female connector.

The structure of the bayonet-type female connector 2*a* is explained next. Note that "bayonet-type" indicates the type wherein the connection is made by a plurality of connecting hocks and stopper portions that engage the engaging hooks. FIG. 3 (*a*) is a perspective diagram and FIG. 3 (*b*) is a partial cutaway perspective diagram, of the case wherein the male connector according to the example is connected to a bayonet-type female connector. The bayonet-type female connector 2*a*, as illustrated in FIG. 1 and FIG. 3, is structured from a socket main unit portion 14 that connects electrically, coaxially, the electric cables 3*a* and 3*b*, through the pin terminal 4 when connected to the male connector 1, a knob portion 15 that is attached rotatably to the outer peripheral surface of the socket main unit portion 14, and a socket outer covering portion 16.

As illustrated in FIG. 3 (*b*), engaging grooves 17, made from guide portions 17*a* that guide the engaging hooks 13 when the male connector 1 is attached to a bayonet-type female connector 2*a*, and stopper portions 17*b* that engage the engaging hooks 13, are formed on the inner peripheral surface of the knob portion 15.

The operation when the male connector 1 is attached to the bayonet-type female connector 2*a* will be explained next. When the male connector 1 is attached to the bayonet-type female connector 2*a*, first, as illustrated in FIG. 3, the operator holds the knob portions 7 and 15, and inserts the male connector 1 into the female connector 2*a*. At this time, the operator performs the insertion while pushing the knob portion 7 towards the holder 6 side. Doing so causes the engaging hooks 13 to be inserted along the guide portions 17*a*.

Following this, the male connector 1 or the female connector 2*a* is rotated to one side to cause the engaging hooks 13 to engage with the stopper portions 17*b*. Doing so causes the male connector 1 and the bayonet-type female connector 2*a* to go into a locked state, thereby electrically connecting the electric cables 3*a* and 3*b* coaxially.

Figure 4:
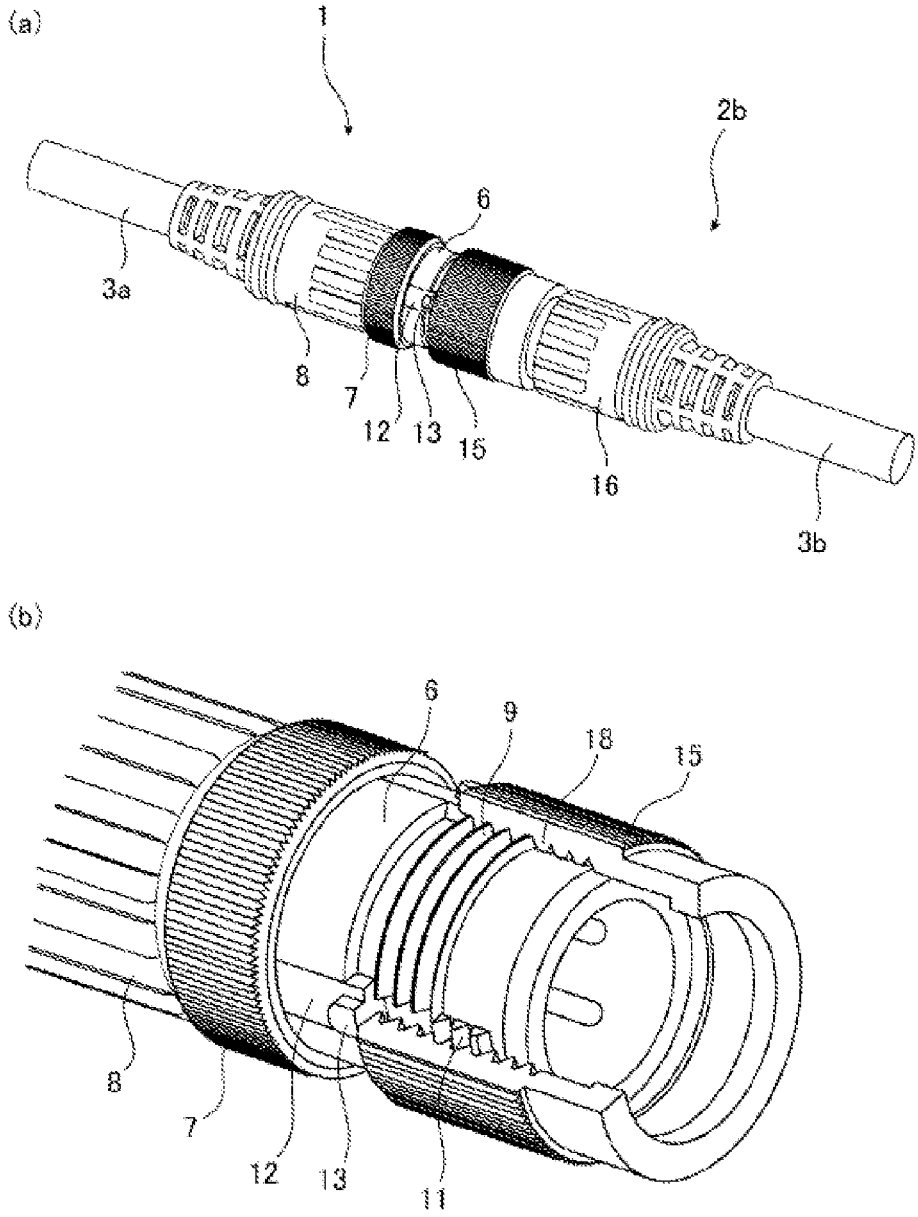
FIG. 4 (*a*) is a perspective diagram and FIG. 4 (*b*) is a partial cutaway perspective diagram, of the case wherein the male connector according to the present invention is connected to a screw-type female connector.

The structure of the screw-type female connector 2*b* will be explained next. FIG. 4 (*a*) is a perspective diagram and FIG. 4 (*b*) is a partial cutaway perspective diagram, of the case wherein the male connector according to the present invention is connected to a screw-type female connector. The screw-type female connector 2*b*, as illustrated in FIG. 4 (*b*) has female threads 18 for screwing together with the male threads 9, formed on the inner peripheral surface of the knob portion 15, instead of the engaging grooves 17 of the bayonet-type female connector 2*a*. The other structures are identical, so identical codes are assigned thereto and explanations thereof are omitted.

The operation when connecting the male connector 1 to a screw-type female connector 2*b* is explained next. When the male connector 1 is connected to the screw-type the female connector 2*b*, first, as illustrated in FIG. 4, the operator holds the knob portions 7 and 15, and screws the guide thread portions 11 and the female threads 18 together. Doing so causes the female threads 18 to be guided to the male threads 9. When the female threads 18 contact the engaging hooks 13, the engaging hooks 13 are biased towards the rearward side, and the knob portion 7 separates from the holder 6. Following this, the male threads 9 and the female threads 18 are screwed together. This causes the male connector 1 and the screw-type female connector 2*b* to go into the locked state, to connect electrically the electric cables 3*a* and 3*b* coaxially.

As described above, in this example, the structure is such that the male threads 9 and the sliding grooves 10 are formed in the holder 6 and the engaging protruding portions 12, having the engaging hooks 13, are formed integrally with the knob portion 7, and thus, for a bayonet-type female connector 2*a*, the operator makes the connection while pushing the engaging hooks 13 towards the holder 6 side by the knob portion 7, while for the screw-type female connector 2*b*, the operator makes the connection by separating the holder 6 from the knob portion 7 through the female threads 18 pushing against the engaging hooks 13, so that the engaging hooks 13 are moved towards the rearward side, and thus the male connection 1 can be connected to female connectors 2 of both the bayonet type and the screw type, without the use of a coil spring as in the conventional connector.

Additionally, the number of parts is reduced because the coil spring is unnecessary, making it possible to reduce parts costs. Furthermore, because when manufacturing a conventional male connector that uses the coil spring it is necessary to form an outer coating portion for the plug by attaching to a die while pushing the coil spring, contained therein, towards the holder side when forming the plug outer coating after the coil spring is put into the holder, the manufacturing was difficult. In contrast, with the male connector according to the example, the coil spring is not used, and thus the manufacturing is easy, enabling a reduction in manufacturing cost.

Additionally, because the guide thread portion 11 for guiding the female threads 18 to the male thread 9 side is formed on the outer peripheral surface of the holder 6, the male threads 9 and the female threads 18 can be screwed together easily when connecting the male connector 1 to the screw-type female connector 2*b*.

Figure 5:
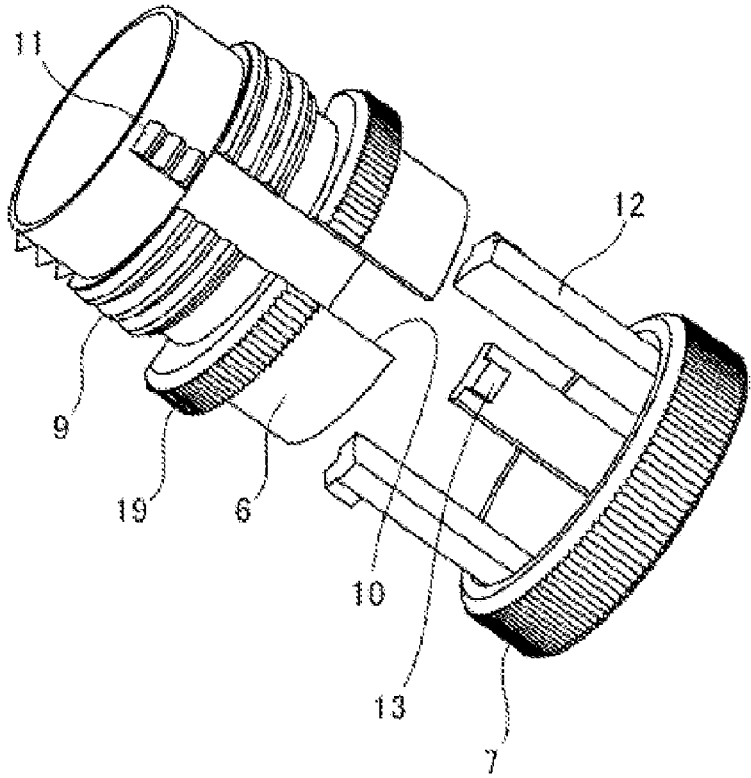
FIG. 5 is a perspective assembly diagram illustrating the structure of the holder and a knob portion according to another example of the present invention.
Figure 6:
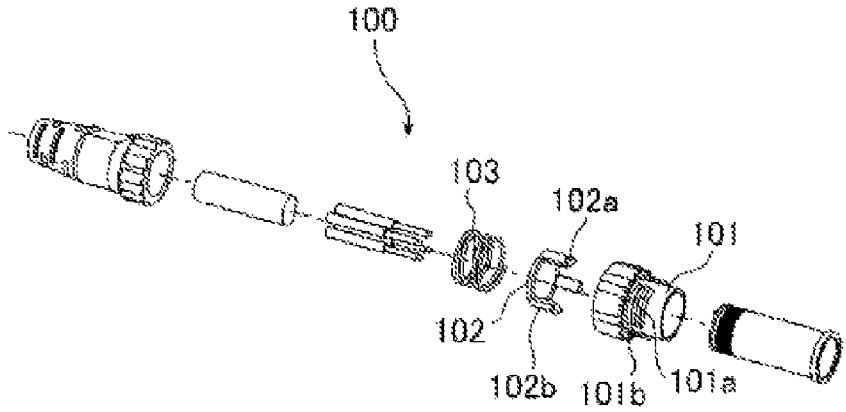
FIG. 6 (*a*) is a perspective assembly diagram and FIG. 6 (*b*) is a sectional perspective diagram, illustrating the structure of a conventional male connector.
Figure 6:
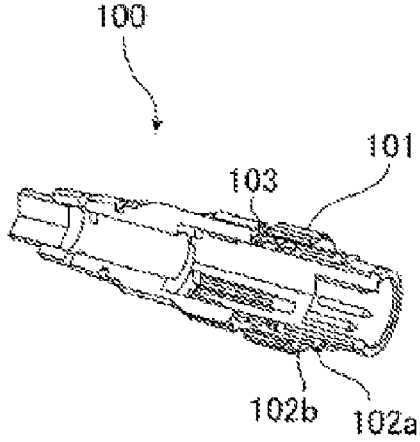

In the above example, there is a danger that when the male connector 1 is connected to a screw-type female connector 2*b*, the knob portion 7 may become separated from the holder 6, so that the operator will not be able to tell that the connection has been completed. Given this, the structure may be one as illustrated in FIG. 5, wherein a dummy knob portion 19 that contacts the knob portion 7 when the engaging protruding portions 12 are positioned at the tip end of the sliding grooves 10 is formed on the outer peripheral surface of the holder 6. Forming the dummy knob portion 19 in this way enables the spacing between the knob portion 7 and the holder 6 to be made visibly shorter when the male connector 1 is connected to a screw-type female connector 2*b*, making it possible for the operator to sense more easily when the connection is completed.

Note, in the male connectors 1 in the above examples the sliding grooves 10 were formed as cutaway portions that pass through to the inner peripheral surface of the holder 6. Alternately, the sliding grooves 10 may be formed as recessed shapes that do not pass through to the inner peripheral surface of the holder 6.

The invention claimed is:

1. A connector connecting electrically between lines by connecting a male connector comprising a plug main unit portion having a line to a female connector comprising a socket main unit portion having a line; wherein:

the male connector comprises:

a holder attached rotatably to an outer peripheral surface of the plug main unit portion, comprising:

male threads formed on an outer peripheral surface of the holder; and sliding grooves formed with predetermined spacing on a rearward side of the outer peripheral surface of the holder; and a knob portion, formed integrally with engaging protruding portions having engaging hooks on tip end sides of the engaging protruding portions, and that slide in the sliding grooves, attached to rotate together with the holder.

2. The connector as set forth in claim 1, wherein the female connector comprises:

a female holder, attached rotatably to an outer peripheral surface of the socket main unit portion, having:

an engaging groove engaging the engaging hook, formed on an inner peripheral surface of the female holder.

3. The connector as set forth in claim 1, wherein the female connector comprises:

a female holder, attached rotatably to the outer peripheral surface of the socket main unit portion, having:

female threads screwing together with the male threads, formed on the inner peripheral surface of the female holder.

4. The connector as set forth in claim 1, further comprising:

a guide thread portion formed at a rearward side of the sliding groove part on the outer peripheral surface of the holder of the male connector.

5. The connector as set forth in claim 1, wherein:

the sliding grooves are cut away so as to pass through to the inner peripheral surface of the holder.

6. The connector as set forth in claim 1, wherein:

the sliding groove is a recessed shape that prevents pass through to the inner peripheral surface of the holder.

7. The connector as set forth in claim 1, further comprising:

a dummy knob portion that contacts the knob portion when the engaging hooks are positioned at the tip end of the sliding grooves formed on the outer peripheral surface of the holder of the male connector.

* * * * *